US006989807B2

(12) United States Patent
Chiang

(10) Patent No.: US 6,989,807 B2
(45) Date of Patent: Jan. 24, 2006

(54) LED DRIVING DEVICE

(75) Inventor: Johnson Chiang, Shindian (TW)

(73) Assignee: ADD Microtech Corp., Taipei (TW)

( * ) Notice: Subject to any disclaimer, the term of this patent is extended or adjusted under 35 U.S.C. 154(b) by 387 days.

(21) Appl. No.: 10/440,117

(22) Filed: May 19, 2003

(65) Prior Publication Data

US 2004/0233145 A1 Nov. 25, 2004

(51) Int. Cl.
*G09G 3/32* (2006.01)

(52) U.S. Cl. ..... 345/82; 315/291; 315/307; 323/364; 340/815.4; 340/815.45; 340/815.52; 345/83; 345/84; 345/98; 372/38.03

(58) Field of Classification Search ..... 345/82
See application file for complete search history.

(56) References Cited

U.S. PATENT DOCUMENTS 4,298,869 A * 11/1981 Okuno ..... 345/82
4,717,868 A * 1/1988 Peterson ..... 323/288
5,598,068 A * 1/1997 Shirai ..... 315/185 R
6,040,663 A * 3/2000 Bucks et al. ..... 315/291
6,078,148 A * 6/2000 Hochstein ..... 315/291
6,441,558 B1 * 8/2002 Muthu et al. ..... 315/149
6,570,505 B1 * 5/2003 Malenfant ..... 340/641
6,798,152 B2 * 9/2004 Rooke et al. ..... 315/209 R
2002/0140379 A1 * 10/2002 Chevalier et al. ..... 315/291
2004/0046673 A1 * 3/2004 Kovarik et al. ..... 340/636.1

* cited by examiner

*Primary Examiner*—Kent Chang
*Assistant Examiner*—Alexander S. Beck
(74) *Attorney, Agent, or Firm*—Bacon & Thomas, PLLC

(57) ABSTRACT

A LED driving device includes a plurality of LEDs, a voltage detecting circuit, and a current switching circuit. When the voltage detecting circuit detects the different voltage level of power source without coupling to a filtering capacitor, it sends a signal to the current switching circuit and then the current switching circuit is automatically activated to electrically rearrange the configuration of LEDs with a predetermined current value by lighting the greatest number of LEDs that improving the power factor and efficiency.

16 Claims, 7 Drawing Sheets

LED DRIVING DEVICE

BACKGROUND OF THE INVENTION

1. Field of the Invention

The present invention relates to a driving device, and more particularly it pertains to a LED driving device capable of improving the power factor and efficiency.

2. Description of the Related Art

Diode, a semi-conductor element, works like a switch, has played an important role in electronic system.

There are many kinds of diode around our life. One kind of diode can be lighting when being energized. This kind of diode we call it Light Emitting Diode (LED).

The application of LED is quite wide. High bright LED is widely used for traffic light, vehicle indicating light, and braking light. Full-color LED display, composed of red LED, green LED, and blue LED, is also used for stadium and street advertisement, such as the larg LED display at outside of Nasdaq marketing center in Times Square, New York city. The 20-foot high screen, composed of 19,000,000 high bright LEDs, is the largest one in the world.

LED has become an indispensable lighting device today because cell phone and portable electronic products are getting more popular. Experts believe that the LED will replace most light source in the near future due to its advantage of space-less, high lighting speed, and long lifetime.

LED is so widely used that many kinds of driving devices and chips are worked out. FIG. 1A is a diagram showing a current versus voltage relationship of a LED. The relation of the voltage and the current can be represented by an exponential function and the relation is similar to an ordinary diode. When the forward voltage is less than some value Vb, only very small current flows through the LED. When the voltage exceeds some value Vb, the current would raise sharply. The sharp current is forward current of LED. Said value Vb we call it barrier voltage. The Vb value is between 1.5V and 3.5V usually. The semiconductor material and doping level decides the barrier voltage Vb. Besides, the wave-length of the light emitted from a LED also depends on the kind of material, for example, red Led is composed of GaAsP.

The LED light output luminous intensity is proportional to LED current for most operating value of LED current, but the approximation usually over-estimates light output at high current value. A typical curve is shown in FIG. 1B. Actually, the driving devices are designed to provide a constant current for stabilizing light emitted and extending the life of LED.

FIG. 1C is a waveform diagram of voltage and current for explaining the behavior of a LED. If we use AC power source to energize the LED, the light will be emitted during the interval T within the positive part of the AC power source because the voltage level of the AC power source is higher than the barrier voltage of the LED. We could couple a bridge rectifier to AC power source for taking the advantage of AC power source. By applying a bridge rectifier, the negative part of AC power source will be converted to positive. FIG. 2A shows the circuit diagram of bridge rectifier. To get a stable voltage supply, a filtering capacitor can be coupled to. FIG. 2B shows the waveform diagram of voltage and FIG. 2C shows the waveform diagram of current related to FIG. 2B. Further, a constant current circuit is added to keep the constant luminance and color of light emitted. FIG. 2D shows the waveform diagram of current in above situation.

It is important that if there is a capacitor or an inductor in the circuit, the current and voltage will be non-synchronous. FIG. 2E is a waveform diagram of current lagging behind voltage waveform. If the voltage Eac is represented as Em Sin ωt, the current Iac is represented as Im Sin(ωt−Θ). In above situation, the product of voltage and current is not always positive. The power value is calculated as VmIm Cos Θ/2 and it is less than the power of the voltage and current in the same phase VmIm/2. The Cos Θ was called power factor.

There are many patents about LED driving device. For example, U.S. Pat. No. 5,936,599, "AC POWERED LIGHT EMITTING DIODE ARRAY CIRCUITS FOR USE IN TRAFFIC SIGNAL DISPLAYS", FIG. 3 shows its circuit diagram. According to this diagram, we see a LED array including a number of series connected polarized LEDs $D_{pair}$ are energized by an AC voltage source coupled to an inductor. Each polarized LEDs including two parallel connected oppositely polarized LEDs. The inductor is taken the place of the resistor which is used to limit the current. The inductor will limit the current with less power loss than the resistor does. To further reduce power loss, a capacitor is coupled to LED array. The capacitor has to be tuned to match up the inductor and the frequency of the AC voltage source. However, the power loss is improved but the power factor is reduced for the existence of the capacitor and inductor. Another disadvantage is that the capacitor and inductor have to be tuned with the frequency of AC voltage source. Besides, the number of LEDs in LED array is dependent on the voltage level of the AC voltage source.

U.S. Pat. No. 5,457,450, "LED TRAFFIC SIGNAL LIGHT WITH AUTOMATIC LOW-LINE VOLTAGE COMPENSATING CIRCUIT", its circuit diagram is shown as FIG. 4. To avoid the overall light intensity dropping down, a mid-voltage compensation circuit 82 and a low-voltage compensation circuit 84 has been designed. Although this patent can avoid light intensity from dropping down without increasing the power consumption, but driving LEDs with increased current will shorten the life of LEDs.

In addition, a stable voltage source is always used to driving LEDs for increasing the lighting time of LED and a filtering capacitor is used for this purpose. The disadvantages for the existence of capacitor are lowering the power factor and the capacitor has to be changed with the frequency of power source. Besides, the life and stability of capacitor is affected by temperature very heavily so that it makes the driving device unstable.

SUMMARY OF THE INVENTION

For overcoming said defects described above, an object of the present invention is to provide an LED driving device in which the LEDs can be driven by the positive part of power source directly.

Another object of the present invention is to provide a LED driving device in which the power factor can be improved.

The other object of the present invention is to provide a LED driving device in which the greater number of LED can be lighted in comparison with conventional LED driving device supplied with the same power source.

These and other objects, features and advantages of the present invention will become more apparent from the following description and the appended claims, taken in connection with the accompanying drawings in which preferred embodiment of the present invention are shown by way of illustrative example.

A BRIEF DESCRIPTION OF THE DRAWINGS

Figure 1A:
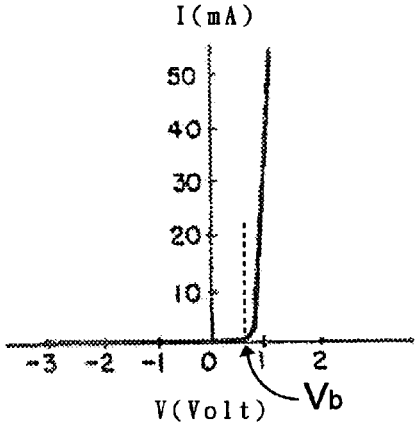
FIG. 1A is a diagram showing a current versus voltage relationship of a LED.
Figure 1B:
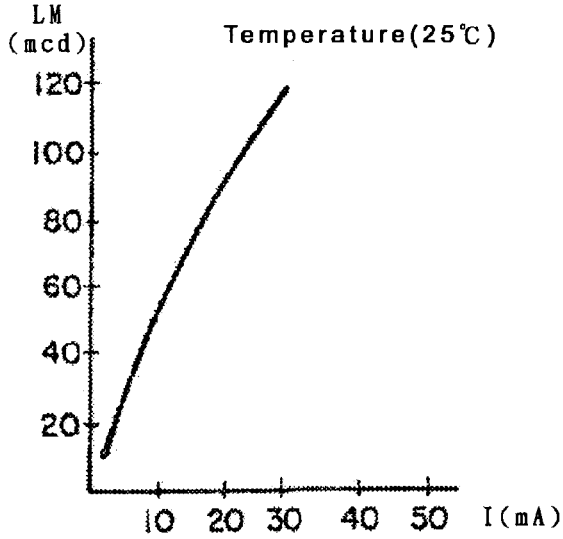
FIG. 1B is a diagram showing a luminous intensity versus current characteristics of a LED.
Figure 1C:
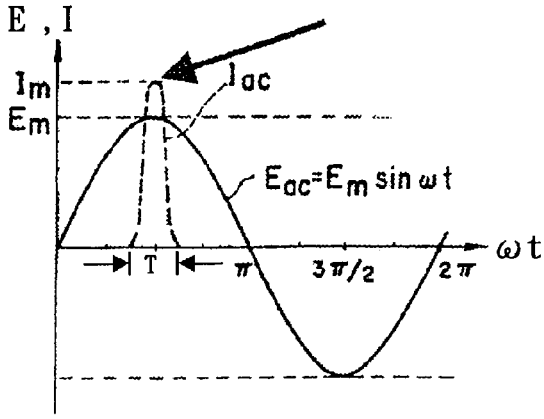
FIG. 1C is a waveform diagram of voltage and current for explaining the behavior of a LED.
Figure 2A:
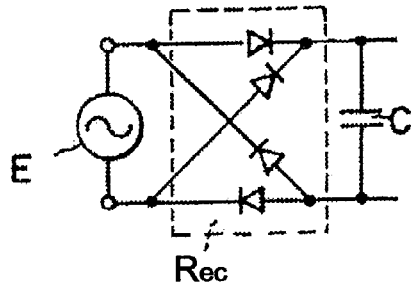
FIG. 2A is a circuit diagram of bridge rectifier.
Figure 2B:
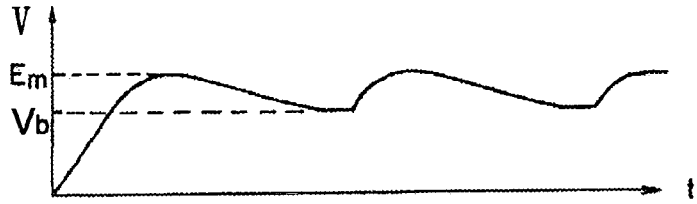
FIG. 2B is a waveform diagram of voltage when power source is coupled to a bridge rectifier and a filtering capacitor.
Figure 2C:
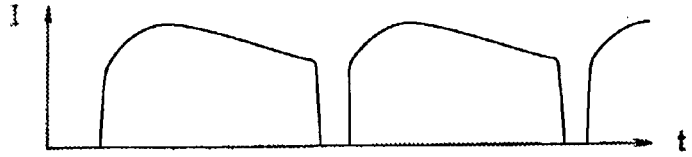
FIG. 2C is a waveform diagram of current related to FIG. 2B.
Figure 2D:
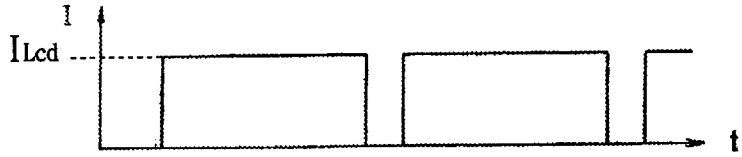
FIG. 2D is a waveform diagram of current when a constant current source circuit is added.
Figure 2E:
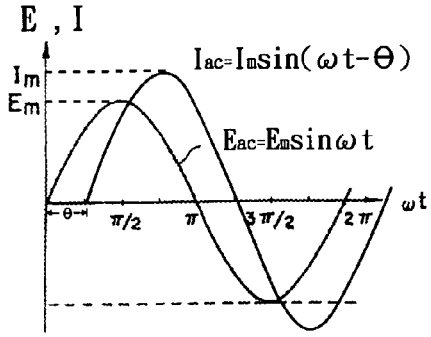
FIG. 2E is a waveform diagram of current lagging behind voltage waveform.
Figure 3:
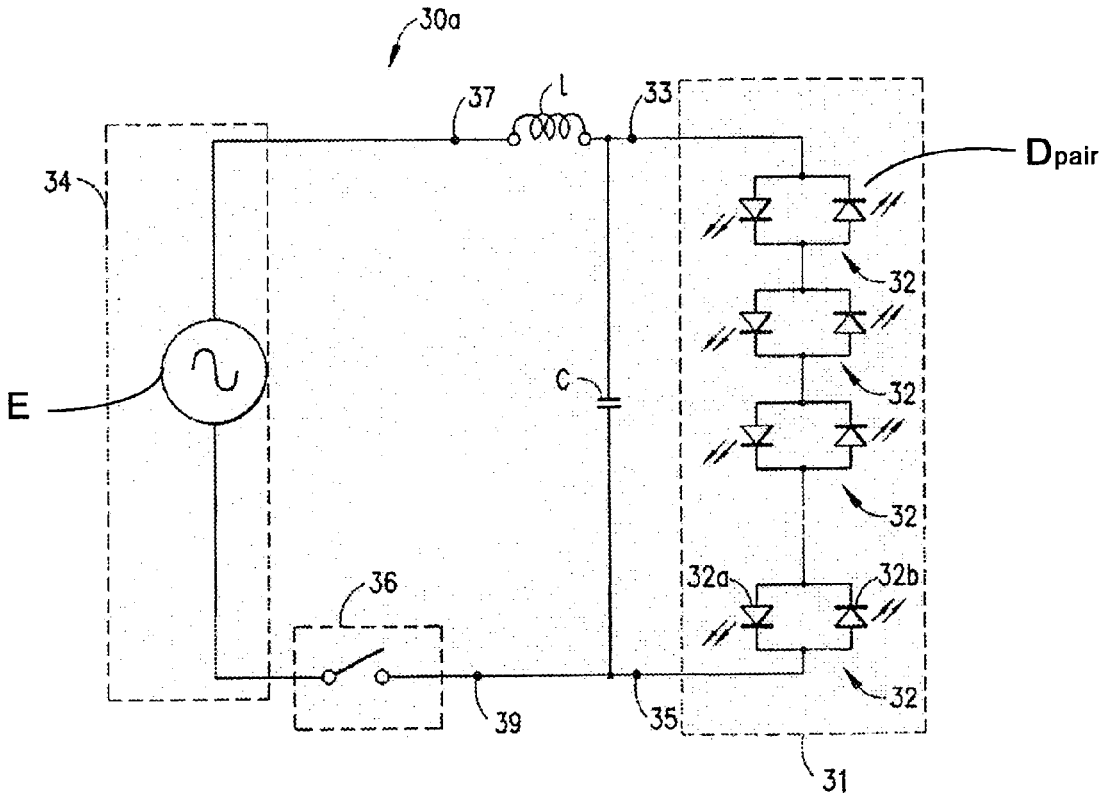
FIG. 3(Prior Art)

FIG. 3 is a circuit diagram disclosed in U.S. Pat. No. 5,936,599.

Figure 4:
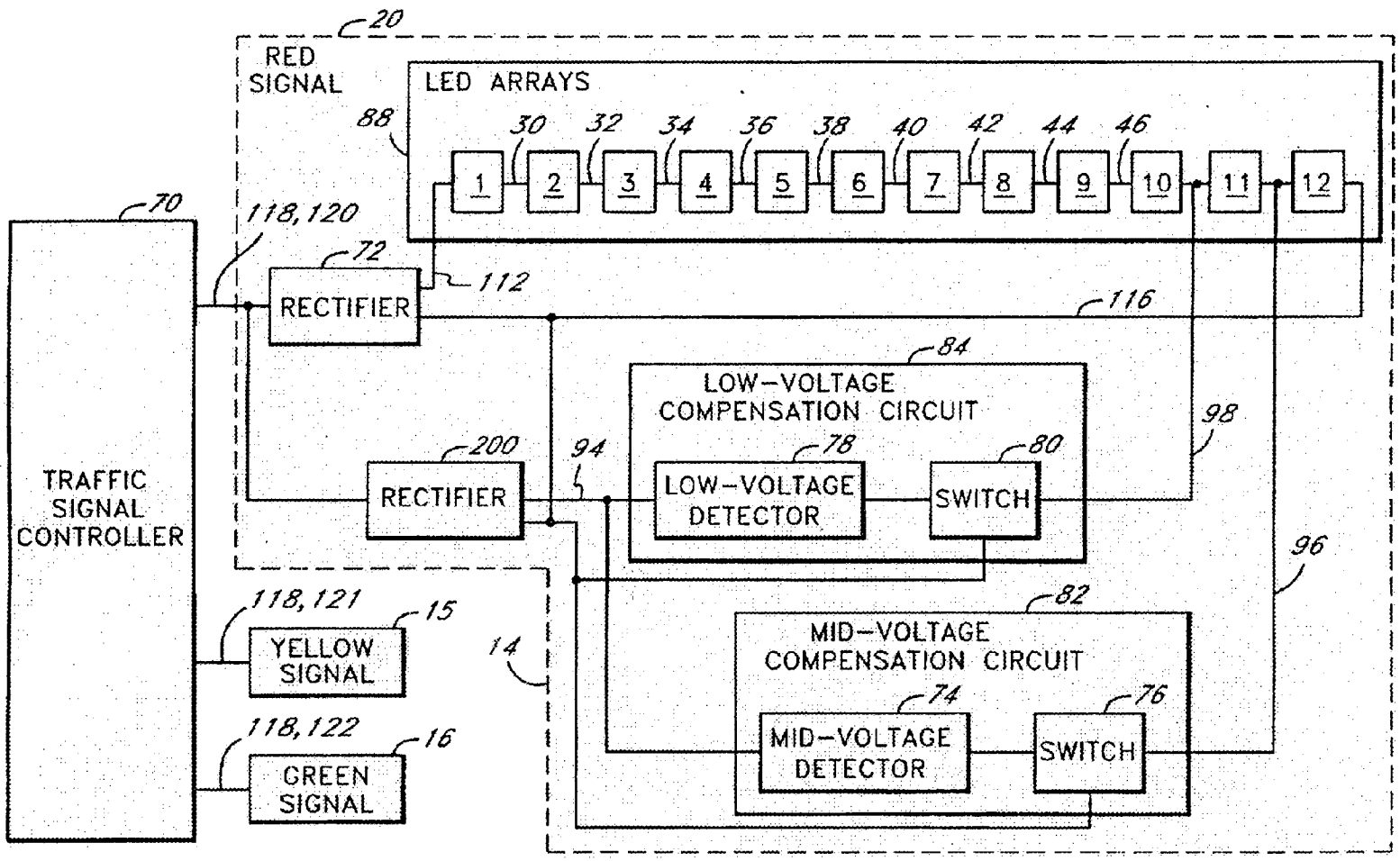
FIG. 4(Prior Art)

FIG. 4 is a circuit diagram disclosed in U.S. Pat. No. 5,457,450.

Figure 5A:
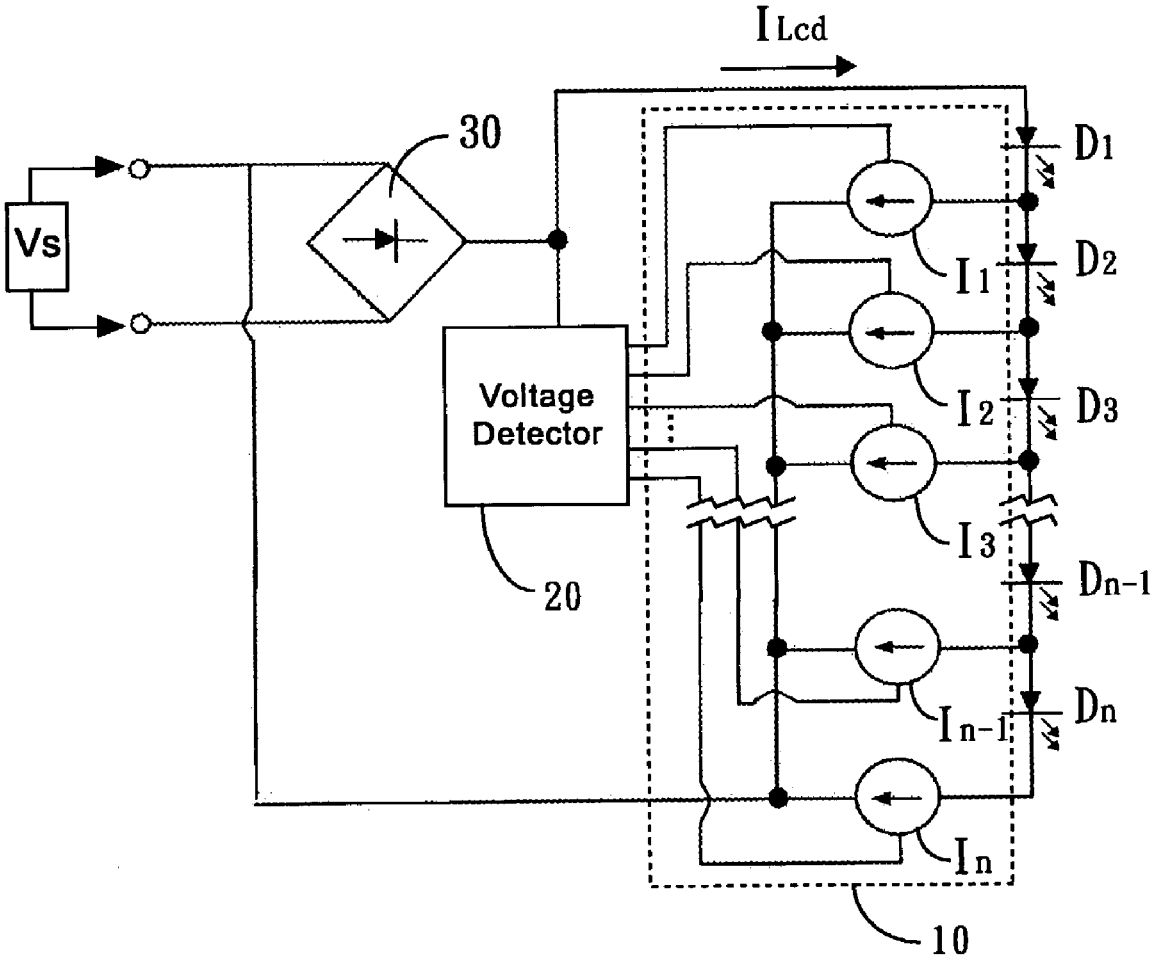

FIG. 5A is a circuit diagram of the first embodiment of the present invention.

Figure 5B:
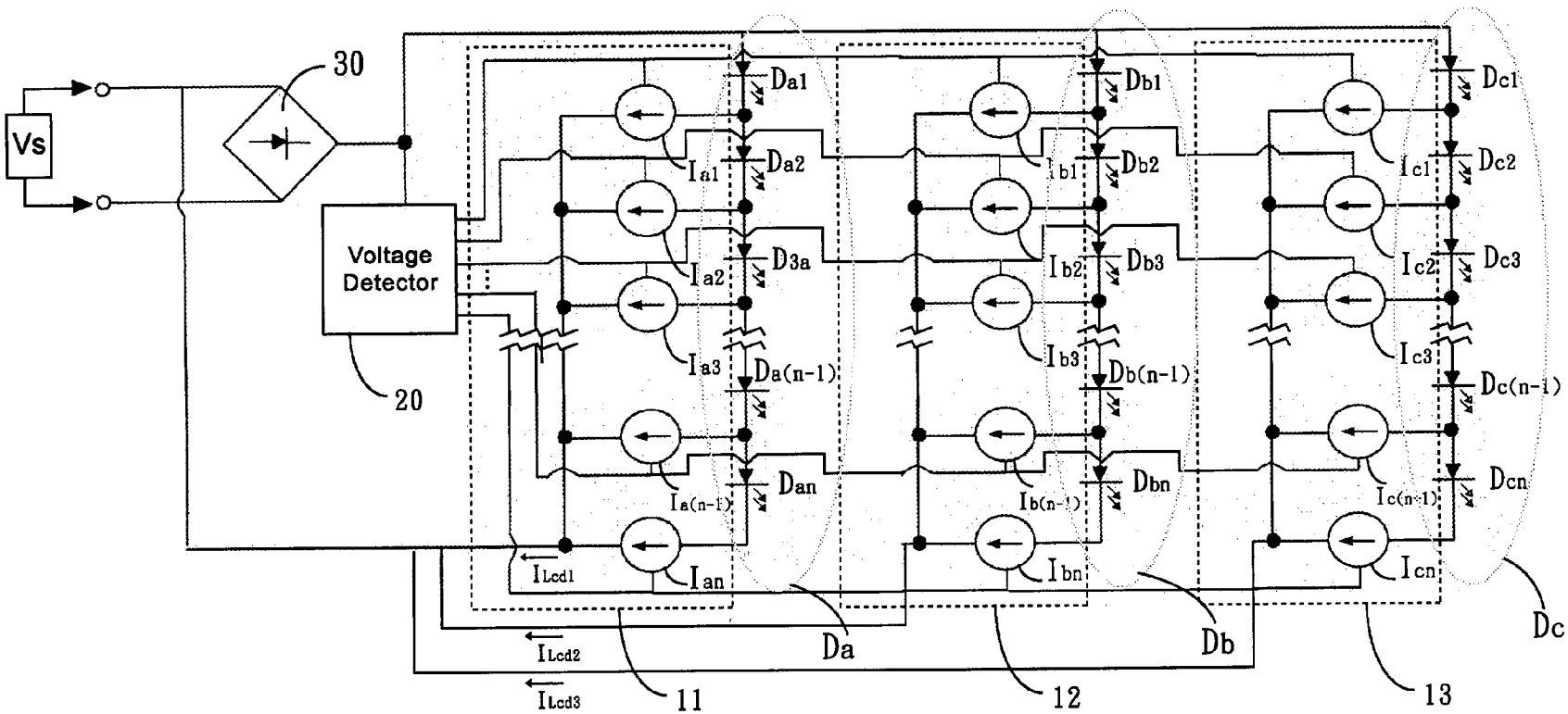

FIG. 5B is a circuit diagram of the second embodiment of the present invention.

Figure 6:
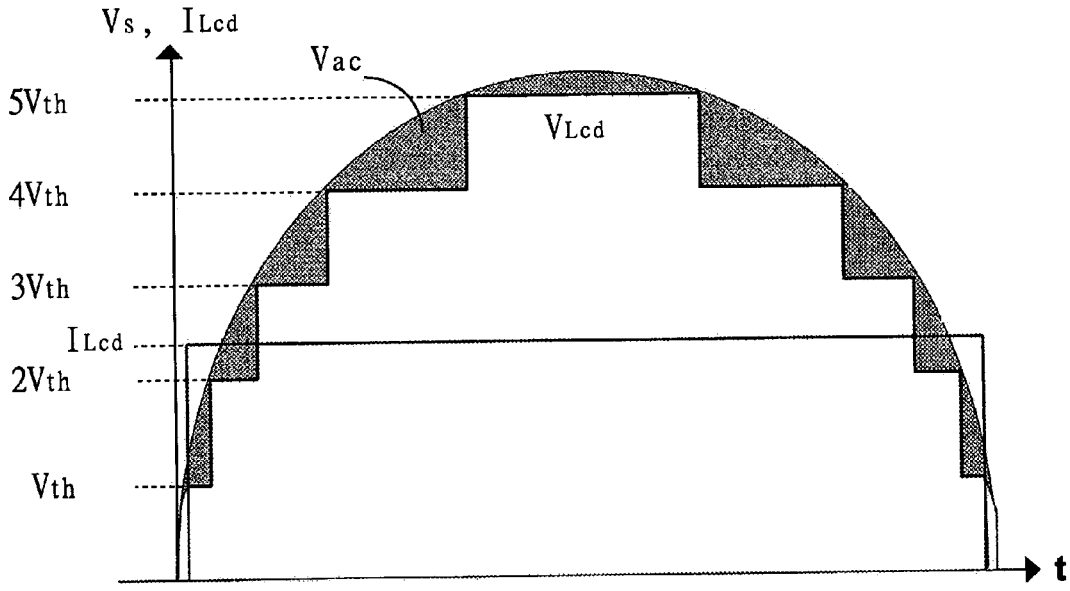

FIG. 6 is a waveform diagram of power source voltage, current and drop voltage on a LED when supplied by an AC power source.

Figure 7:
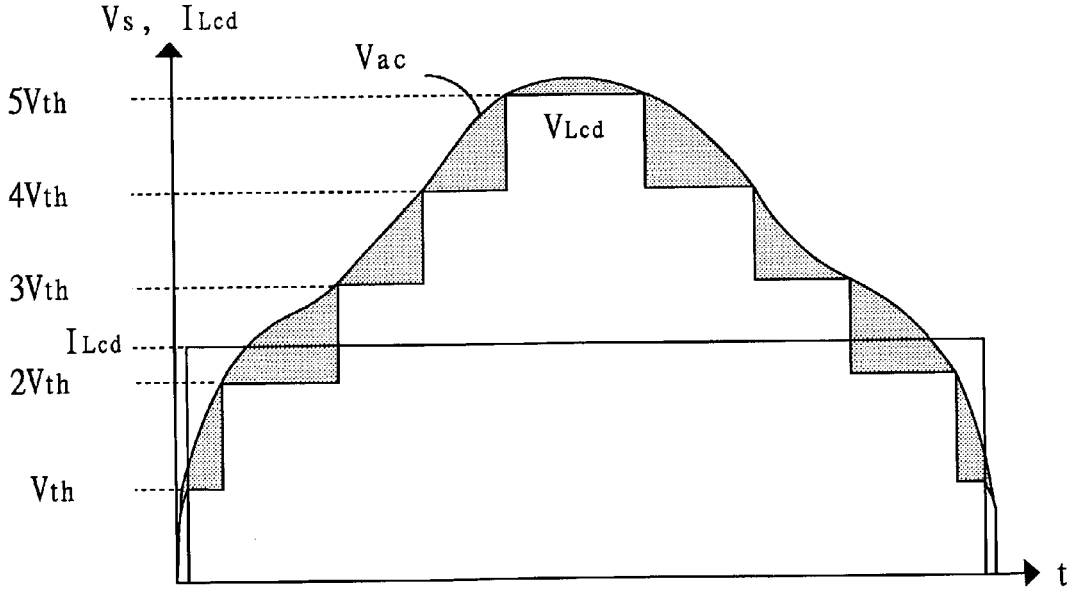

FIG. 7 is a waveform diagram of power source voltage, current and drop voltage on a LED when supplied by any kind of power source.

DETAILED DESCRIPTION OF THE PREFERRED EMBODIMENT

FIG. 5A is a circuit diagram of the first embodiment of the present invention. It comprises a LED string, a voltage detecting circuit 20 and a current switching circuit 10. The power source Vs can be any kind of input voltage source. Said voltage detecting circuit 20 is used for detecting the voltage level of the power source Vs and said current switching circuit 10 including grounded current controlling unit $I_1$, $I_2$, $I_3$, . . . , $I_{(n-1)}$, and $I_n$.

Said LED string connected in parallel across the power source Vs is composed of series connected LED sets D1, D2, D3, . . . , Dn−1, and Dn. Each of said LED sets is composed of a LED or at least two LEDs in any electric configuration.

The current controlling unit $I_1$, $I_2$, $I_3$, . . . , $I_{(n-1)}$, $I_n$ is coupled to one of the LED sets. The voltage detecting circuit 20 detects the voltage level of power source and sends a signal to said current switching circuit 10 and said current switching circuit 10 is automatically activated to enable the current controlling unit $I_1$, $I_2$, $I_3$, . . . , $I_{(n-1)}$, $I_n$ and electrically rearrange said configuration of LED sets with a predetermined current value.

The present invention can be supplied by any kind of power source without being coupled to a filter capacitor. In order to increase the lighting time of LED, a bridge rectifier circuit 30 can be used to convert the negative part of the power source Vs.

The Voltage detecting circuit 20 and current switching circuit 10 of the present invention can be supplied by a DC voltage derived from said power source Vs or derived form another power source.

For a AC power source, the voltage detecting circuit 20 is designed that when the voltage of power source exceeds the barrier voltage Vth1 of LED set, the voltage detecting circuit 20 will only enable current controlling unit I1. Vth1 is equal to or higher than the sum of the barrier value of total LEDs, If the LEDs in the LED set are the same, then, Vth1 is equal to or higher than n*Vb. At this time, the current path is power source Vs, LED set D1, and current controlling unit I1, and ground. When the voltage of power source raises to Vth1+Vth2, if the LED set D2 and LED set D1 are identical, then Vth2=Vth1=Vth, i.e. when voltage detecting circuit 20 detects the voltage of power source Vs exceeding 2*Vth, the voltage detecting circuit 20 will disable I1 and only enable current controlling unit I2. The new current path is power source Vs, LED set D1, LED set D2, and current controlling unit I2, and ground. When the power source is raised, the controlling unit I2 is disabled and I3 is enabled and so on. In conclusion, only one current controlling unit will be enabled at any time. To keep the brightness, the current of the current controlling unit is designed to a constant value.

Said current controlling unit can be accomplished by any current controlling circuit. It can be designed to be a constant current source or a limited current source.

In practice, the LEDs included in the LED set can be different color from each other and could emit any color or intensity light. The simplest method is using red LED string, green LED string and blue LED string to combine. FIG. 5A shows a circuit diagram of the first embodiment of the present invention.

We change the original LED sets $D_1$, $D_2$, $D_3$, . . . , $D_{(n-1)}$, $D_n$ of a LED string to a LED array including three LED strings. Red LED sets $D_{a1}$, $D_{a2}$, $D_{a3}$, . . . , $D_{a(n-1)}$, $D_{an}$; green LED sets $D_{b1}$, $D_{b2}$, $D_{b3}$, . . . , $D_{b(n-1)}$, $D_{bn}$; and blue LED sets $D_{c1}$, $D_{c2}$, $D_{c3}$, . . . , $D_{c(n-1)}$, $D_{cn}$. The current controlling unit $I_{a1}$, $I_{a2}$, . . . $I_{a(n-1)}$, $I_{an}$, $I_{b1}$, $I_{b2}$, . . . $I_{b(n-1)}$, $I_{bn}$, $I_{c1}$, $I_{c2}$, . . . $I_{c(n-1)}$, $I_{cn}$ are controlled by current switching circuit 11, 12, 13 separately.

The number of strings can be more than three and the LEDs in the LED sets of different string may not be the same.

FIG. 6 is a waveform diagram of power source voltage, current and drop voltage on LEDs when supplied by an AC power source. There are five LED sets for this diagram. Regardless of the power loss due to stray resistors and capacitors, because there is no capacitor in the present invention, the output power for the power source is the product of the voltage area of power source and $I_{Led}$. The voltage across all the energized LED is a step shape and the power is the product of area of the step shape and $I_{Led}$. The difference between these two powers is the power loss and the power loss is equal to the area of the shadow. The difference in voltage between the power source and the across voltage of total energized LEDs will drop on the current controlling unit. FIG. 7 is a waveform diagram of power source voltage, current and drop voltage on a LED when supplied by any kind of power source. The output power and power of all LEDs are the same as above.

Mentioned above is an ideal situation. In practice, the lowest voltage to make current controlling unit work with a predetermined value has to be overcome. The voltage level of voltage detecting circuit must be higher. The voltage across the current controlling unit we represent it as Vd. Vd is smaller than the barrier voltage of LED set. The current of current controlling unit is about 100 mA and the lowest value of vd will be designed less than 0.1V.

It is important that the predetermined current value of any string can be adjusted for fit to various situations. It is the same that the voltage level of the voltage detecting circuit also can be adjusted.

While the present invention has been described with reference to the illustrative embodiment, this description is not intended to be construed in a limited sense. Various modifications of the illustrative embodiment of the invention such as the different accomplished circuit for the voltage detecting circuit and current switching circuit will be apparent to those skilled in the art with reference to this description. It is therefore completed that the appended claims will cover any such modifications or embodiments as fall within the true scope of the invention.

What is claimed is:

1. A LED driving device lighting a plurality of LEDs by the positive part of a power source directly without the existing of a filtering capacitor so that said LED driving device has better power factor and better efficiency in comparison with conventional LED driving device, said LED driving device comprising:

a LED array connected in parallel across said power source;

said LED array composed of one LED string or at least two LED strings connected in parallel, each of said LED strings is composed of a series of connected LED sets, each of said LED sets is composed of at least one LED in any electric configuration;

a voltage detecting circuit detecting the voltage level of said power source;

a current switching circuit coupled to said voltage detecting circuit and to said LED sets so that when said voltage detecting circuit detects the different voltage level of said power source, said voltage detecting circuit sends a signal to said current switching circuit and said current switching circuit is automatically activated to electrically rearrange said configuration of LED sets with a predetermined current value by lighting the greatest number of LEDs; and wherein the greatest number of LEDs illuminated per LED set varies based on the voltage level detected by said voltage detecting circuit.

2. A LED driving device according to claim 1 wherein said power source is coupled to a bridge rectifier for converting the negative part of said power source to positive part.

3. A LED driving device according to claim 1 wherein said voltage detecting circuit and said current switching circuit are supplied by a DC voltage derived from said power source.

4. A LED driving device according to claim 1 wherein said voltage detecting circuit and said current switching circuit are supplied by a DC voltage derived from another power source.

5. A LED driving device according to claim 1 wherein said current switching circuit comprises at least one current controlling unit, each being coupled to one of said LED sets and comprising at least one transistor.

6. A LED driving device according to claim 1 wherein the current value of said current switching circuit is designed to be limited.

7. A LED driving device according to claim 5 wherein the current value of said current controlling unit is designed to be limited.

8. A LED driving device according to claim 1 wherein the current value of said current switching circuit is designed to be fixed.

9. A LED driving device according to claim 5 wherein the current value of said current controlling unit is designed to be fixed.

10. A LED driving device according to claim 1 wherein the current value of said current switching circuit is adjustable.

11. A LED driving device according to claim 5 wherein the current value of said current controlling unit is adjustable.

12. A LED driving device according to claim 6 wherein the current value of said current switching circuit is adjustable.

13. A LED driving device according to claim 7 wherein the current value of said current controlling unit is adjustable.

14. A LED driving device according to claim 8 wherein the current value of said current switching circuit is adjustable.

15. A LED driving device according to claim 9 wherein the current value of said current controlling unit is adjustable.

16. A LED driving device according to claim 1 wherein the voltage levels of said voltage detecting circuit are adjustable.

* * * * *